US006355870B1

(12) United States Patent
Tsai et al.

(10) Patent No.: US 6,355,870 B1
(45) Date of Patent: Mar. 12, 2002

(54) APPARATUS AND METHOD FOR REPRODUCTION OF TUNE DATA

(75) Inventors: Tom Jen Tsai; Shigehiko Mizuno, both of Hamamatsu (JP)

(73) Assignee: Yamaha Corporation (JP)

( * ) Notice: Subject to any disclaimer, the term of this patent is extended or adjusted under 35 U.S.C. 154(b) by 0 days.

(21) Appl. No.: 09/717,552

(22) Filed: Nov. 21, 2000

(30) Foreign Application Priority Data

Nov. 25, 1999 (JP) ..... 11-334886

(51) Int. Cl.[7] ..... G10H 7/00
(52) U.S. Cl. ..... 84/605; 84/612
(58) Field of Search ..... 84/605, 612, 609, 84/634, 636, 692

(56) References Cited

U.S. PATENT DOCUMENTS

| | | | | | |
|---|---|---|---|---|---|
| 4,622,879 | A | * | 11/1986 | Matsubara | 84/609 |
| 4,768,413 | A | * | 9/1988 | Fujimori | 84/609 |
| 4,947,723 | A | * | 8/1990 | Kawashima et al. | |
| 5,233,521 | A | * | 8/1993 | Kimpara | 84/609 |
| 5,350,882 | A | * | 9/1994 | Koguchi et al. | 84/652 X |
| 5,512,704 | A | * | 4/1996 | Adachi | 84/605 |
| 5,568,329 | A | * | 10/1996 | Hirohata et al. | |
| 6,025,552 | A | * | 2/2000 | Mukaino et al. | 84/605 |

FOREIGN PATENT DOCUMENTS

JP 62-175796 8/1987

* cited by examiner

*Primary Examiner*—Jeffrey Donels
(74) *Attorney, Agent, or Firm*—Morrison & Foerster LLP

(57) ABSTRACT

A tune data reproduction system is designed to operate differently in a reproduction mode and a quick reverse mode by using tune data and quick reverse sound data. Herein, the tune data represent progression of notes of musical performance, while the quick reverse sound data represent repetition of a prescribed sound indicating a quick reverse operation or reverse reproduction sounds being made from the tune data. In the reproduction mode, the system performs reproduction on the tune data to produce musical tones of the notes at a desired tempo in accordance with the progression of the musical performance. In the quick reverse mode, the system produces the quick reverse sound or the reverse reproduction sounds representing the musical tones of the notes which are reversely reproduced in a reverse direction reverse to the progression of the musical performance at a high speed. In order to prevent sound duration from becoming excessively short in the quick reverse mode, each of the musical tones is generated in response to note-off information being read from the tune data, then, it is muted after a lapse of a prescribed time (e.g., 100 ms). This allows a user of the system to clearly recognize passage of the quick reverse operation. Thus, the user is able to certainly listen to the musical tones being reversely reproduced and is capable of tracing back the tune data in the reverse direction at a high speed.

23 Claims, 7 Drawing Sheets

APPARATUS AND METHOD FOR REPRODUCTION OF TUNE DATA

BACKGROUND OF THE INVENTION

1. Field of the Invention

This invention relates to apparatuses and methods for performing reverse reproduction on tune data by reverse-direction addressing (or reverse addressing). This invention also relates to recording media storing programs for reverse reproduction of tune data.

2. Description of the Related Art

Conventionally, engineers propose automatic performance apparatuses that perform reverse reproduction on tune data to produce reverse reproduction sounds or quick reverse sounds, an example of which is disclosed by Japanese Unexamined Patent Publication No. Sho 62-175796 (which corresponds to U.S. Pat. No. 4,768,413). In reverse reproduction of the tune data, the apparatus starts generation of sound in response to note-off data being read out, then, the apparatus starts muting of sound in response to note-on data being read out, wherein the note-on data and note-off data are originally recorded for normal reproduction of sound of the tune data.

Namely, the conventional apparatuses employ the aforementioned method of the reverse reproduction in which the generation of the sound is started when the note-off data is read out, then, the muting of the sound is started when the note-on data is read out. This method suffers from a problem in that in high-speed reverse reproduction (or quick reverse), a duration between a timing to start generation of the sound and a timing to start muting of the sound becomes too short.

SUMMARY OF THE INVENTION

It is an object of the invention to provide an apparatus and a method for reproduction of tune data in which even in high-speed reverse addressing to designate constituent notes of the tune data in a reverse direction reverse to a normal direction corresponding to progression of musical performance at a high speed, reverse reproduction can be adequately performed on the tune data to produce reverse reproduction sounds without causing excessive reduction in sound duration between generation start timings and mute start timings in connection with the constituent notes of the tune data.

A tune data reproduction system of this invention is designed to operate differently in a reproduction mode and a quick reverse mode (or reverse reproduction mode) by using tune data and quick reverse sound data. Herein, the tune data represent progression of notes of musical performance and are constructed by at least note-on information and note-off information with respect to each of the notes. The quick reverse sound data represent repetition of a prescribed sound indicating a quick reverse operation. Or, the quick reverse sound data are made based on the tune data to represent the notes which are reversely arranged in a reverse direction being reverse to progression of the musical performance. In the reproduction mode, the system performs reproduction on the tune data to produce musical tones of the notes at a desired tempo in accordance with the progression of the musical performance. Herein, the system starts generation and muting with respect to each of the notes in response to the note-on information and note-off information being respectively read from the tune data. In the quick reverse mode, the system produces the quick reverse sound based on the quick reverse sound data, or the system performs high-speed reverse reproduction on the tune data to reversely produce the musical tones in the reverse direction at a high speed. In order to prevent sound duration from becoming excessively short in the quick reverse mode, each of the musical tones is generated in response to note-off information being read from the tune data, then, it is muted after a lapse of a prescribed time (e.g., 100 ms). This allows a user of the system to clearly recognize passage of the quick reverse operation. Thus, the user is able to certainly listen to the musical tones being reversely reproduced and is capable of tracing back the tune data in the reverse direction at a high speed.

Specifically, in the reverse reproduction mode, the system performs reverse addressing on the tune data in the reverse direction in parallel with creation of the reverse reproduction sounds. This allows the user to easily search the tune data in the reverse direction. In addition, the tune data and quick reverse sound data (or reverse reproduction sound data) are constructed by prescribed waveform data or sequence data containing plenty of note events. As those data, it is possible to use any types of sound data other than MIDI data, for example. Further, the quick reverse sound data are produced by "looping" for repeatedly reading a part or an entire part of sound data. Hence, it is possible to produce the quick reverse sound suited to the quick reverse mode by using a relatively small amount of sound data.

BRIEF DESCRIPTION OF THE DRAWINGS

These and other objects, aspects and embodiments of the present invention will be described in more detail with reference to the following drawing figures, of which.

DESCRIPTION OF THE PREFERRED EMBODIMENTS

This invention will be described in further detail by way of examples with reference to the accompanying drawings.

[A] Hardware Configuration

Figure 1:
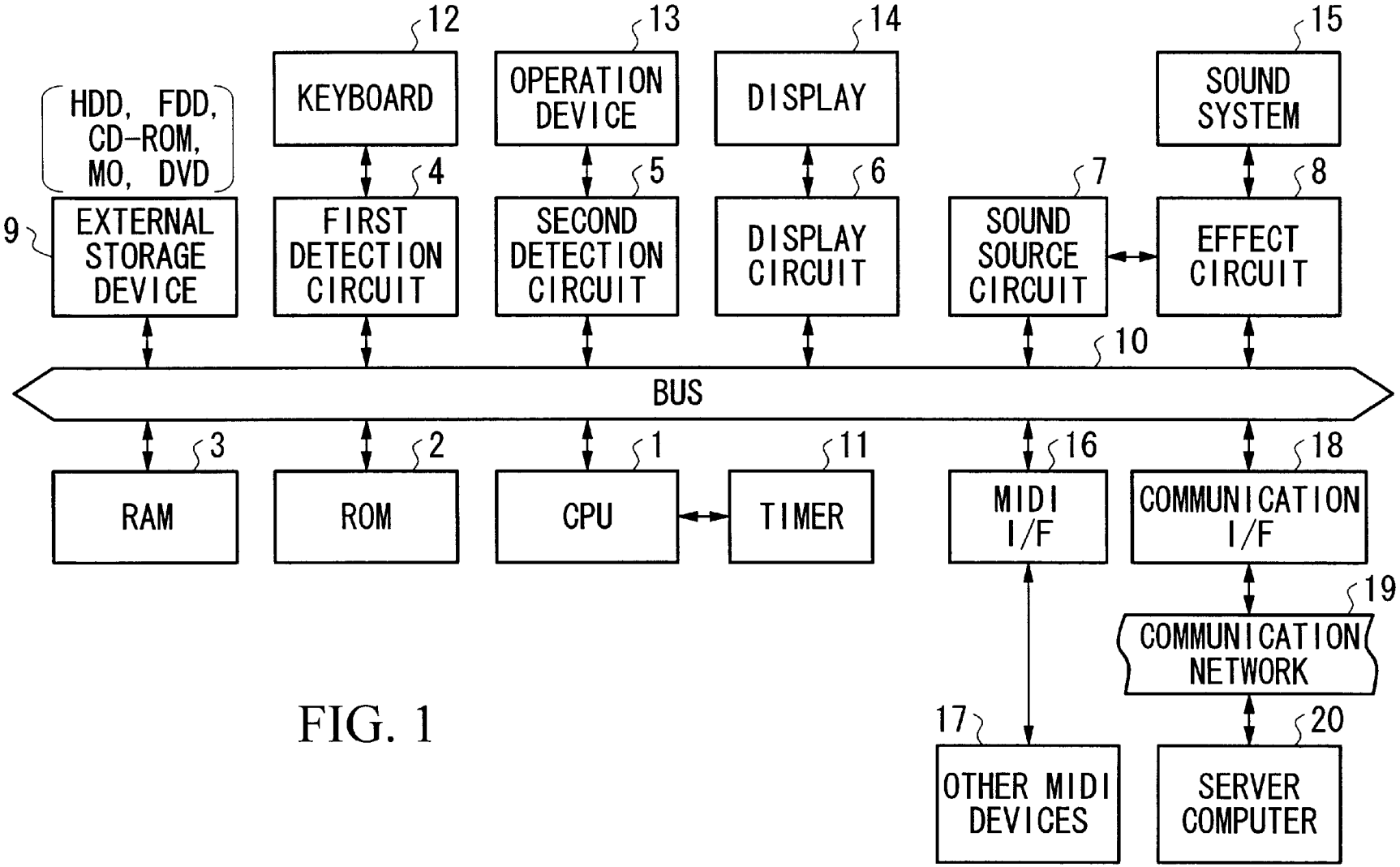
FIG. 1 is a block diagram showing a hardware configuration of a tune data reproduction system in accordance with a preferred embodiment of the invention.

FIG. 1 shows a hardware configuration of a tune data reproduction system in accordance with a preferred embodiment of the invention. The tune data reproduction system of FIG. 1 contains a central processing unit (CPU) 1, a read-only memory (ROM) 2, a random-access memory (RAM) 3, a first detection circuit 4, a second detection circuit 5, a display circuit 6, a sound source circuit 7, an effect circuit 8 and an external storage device 9, all of which are interconnected with each other by way of a bus 10.

The CPU 1 is used to perform overall controls on the system and is connected with a timer 11 that is used for generation of a tempo clock signal and an interrupt clock signal as well as setting of duration of sound. That is, the CPU 1 performs a variety of controls in accordance with prescribed programs. Particularly, the CPU 1 is designed to pivotally execute processes for reproduction of tune data in accordance with the present embodiment of the invention. The ROM 2 stores prescribed control programs for controlling the tune data reproduction system. The control programs contain basic programs for reproduction of tune data, various processing programs regarding reproduction of the tune data, and a variety of data and tables. The RAM 3 is used to store data and parameters that are needed for execution of processes. In addition, the RAM 3 can be used as a work area for temporarily storing various kinds of data under the processes in progress.

The first detection circuit 4 is connected with a keyboard device 12 containing keys being operated by a user (e.g., performer), and the second detection circuit 5 is connected with an operation device 13 containing various types of operators such as panel switch buttons and a mouse (not shown). The display circuit 6 is connected with a display 14 for displaying visual images and/or characters on a screen. So, the user is capable of operating the devices 12 and 13 while watching displayed contents on the screen of the display 14. The effect circuit 8 which is configured by a digital signal processor (DSP) or else is connected with a sound system 15. The sound system 15 is assembled together with the sound source circuit 7 and effect circuit 8 to configure a musical tone output section, which contributes to generation of musical tones based on various performance information data containing musical tone data in accordance with prescribed tune data reproduction processes.

The operation device 13 installs tempo operators and operation buttons for instructing prescribed operations, namely, "reproduce (or playback)", "fast forward (or high-speed reproduction in a forward direction)", "quick reverse (or high-speed reproduction in a reverse direction)" and "stop", for example. The display 14 displays on the screen corresponding operation buttons, which can be operated by the operation device 13 (e.g., mouse), by software. By manually operating the operation buttons of the operation device 13 or by operating the operation buttons on the screen with clicks of the mouse, it is possible to activate the system in desired modes. Using the tempo operators, the user is capable of changing a tempo of music (e.g., automatic performance) being reproduced in each mode. The display 14 displays words (or lyric) of a song and/or chords of a tune in response to tune data on the screen. So, the system is able to indicate the word and/or chord being presently designated by reproduction of the tune data by changing colors in display, for example. Incidentally, the system can be configured to indicate a present location of the tune which is being subjected to a quick reverse mode.

The external storage device 9 can be configured by any types of drives such as the hard-disk drive (HDD), compact-disk-read-only-memory (CD-ROM) drive, floppy-disk drive (FDD), magneto-optic (MO) disk drive and digital versatile disk (DVD) drive. That is, the external storage device 9 is capable of storing various control programs and various kinds of data including tune data. Therefore, it is possible to supply the system with processing programs and various kinds of data regarding processing by using the external storage device 9 other than the ROM 2. In addition, it is possible to supply the system with the programs and data from the external storage device by way of a communication interface or else.

In the present embodiment, the bus 10 is connected with a MIDI interface (where "MIDI" is the known standard for "Musical Instrument Digital Interface") 16, by which the system is to be connected with other MIDI devices 17. The present embodiment is not necessarily limited to use the MIDI interface being specially designed for communications of MIDI information. Hence, it is possible to use general-purpose interfaces such as the RS-232C interface, USB (i.e., Universal Serial Bus) interface, IEEE 1394 interface (where "IEEE" is an abbreviation for "Institute of Electrical and Electronics Engineers") as replacement of the MIDI interface 16. In this case, it is possible to modify the system such that data other than MIDI messages can be simultaneously communicated via the interface. In addition, the bus 10 is connected with a communication interface 18, by which the system is connected with a server computer 20 via a communication network 19. Thus, it is possible to download from the server computer 20 the processing programs and data, which are stored in the external storage device 9 of the system.

The tune data reproduction system of this invention can be actualized in a form of an electronic musical instrument installing the keyboard device 12 and operation device 13 as shown in FIG. 1. Of course, application of this invention is not necessarily limited to electronic musical instruments. Hence, this invention can be realized in other forms such as a personal computer that runs application software. Or, this invention can be applied to other devices such as game devices, communication terminals of cellular phones and player pianos, for example. Incidentally, the electronic musical instrument realizing this invention is not necessarily limited to a musical instrument of a keyboard type. In other words, the electronic musical instrument realizing this invention can be configured in other types of musical instruments such as stringed instruments, wind instruments and percussion instruments. In addition, the electronic musical instrument realizing this invention is not necessarily limited to one incorporating a sound source device and an automatic performance device therein. That is, the electronic musical instrument realizing this invention can be configured by using the aforementioned devices which are independently provided and which are connected together by means of communication tools such as MIDI tools and networks, for example.

The sound source circuit 7 can be actualized by any types of configurations. That is, the sound source circuit 7 can be configured by a specific hardware, or it can be configured by a DSP that runs microprograms. Or, it can be configured by a CPU that runs software programs. Or, it can be configured by desired combination of the aforementioned configurations.

[B] First Embodiment

Figure 2:
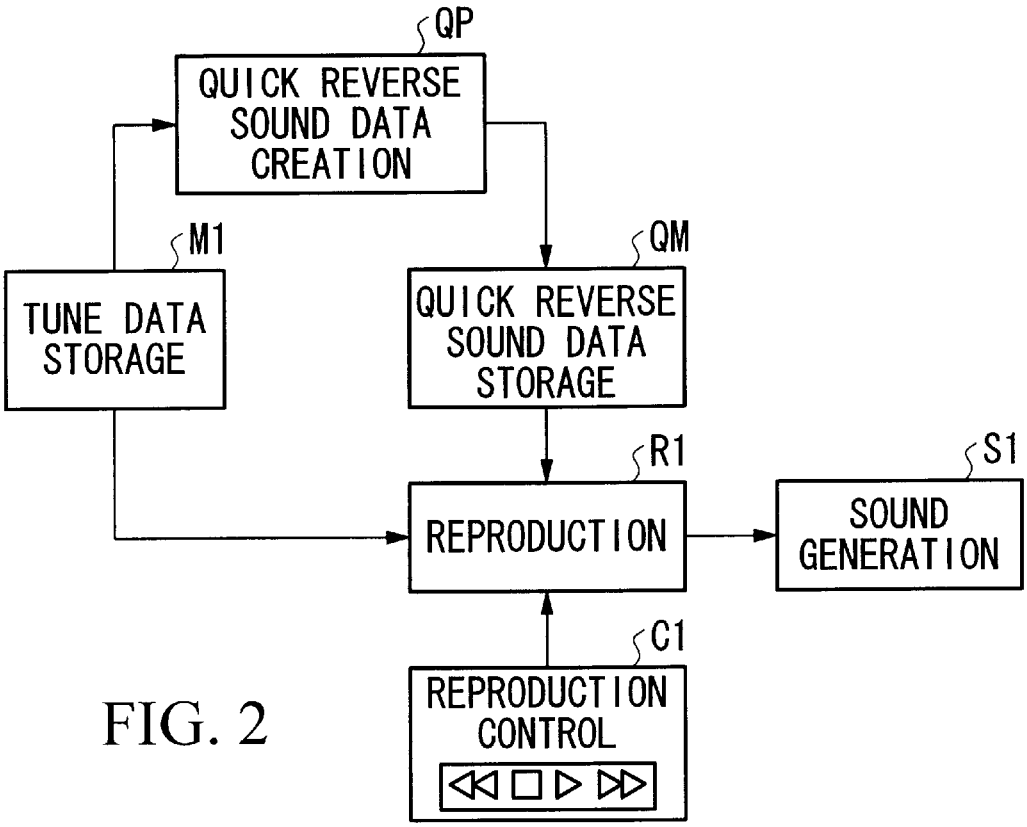
FIG. 2 is a block diagram showing function blocks for realizing the tune data reproduction system of the first embodiment.

The tune date reproduction system of the first embodiment provides quick reverse sound data independently of normal tune data. That is, the system of the first embodiment is designed to reproduce the quick reverse sound data when a user instructs reverse addressing of the tune data. FIG. 2 shows function blocks of the tune data reproduction system of the first embodiment, which contains a tune data storage block M1, a reproduction control block C1, a reproduction block R1 and a sound generation block S1. In order to perform normal reproduction of tune data, the user operates the operation device 13 or the reproduction button on the screen of the display 14, so that the reproduction block R1 performs a normal reproduction process in response to a reproduction instruction given from the reproduction control block C1. Herein, the tune data stored in the tune data storage block M1 are sequentially read out by normal tempo clock pulses in an order of progression of musical performance, so that the sound generation block S1 generates corresponding sounds (e.g., musical tones) in a normal reproduction mode.

The system of the first embodiment is characterized by installing a quick reverse sound data creation block QP and a quick reverse sound data storage block QM in addition to the aforementioned blocks in FIG. 2. Herein, the quick reverse sound data creation block QP creates in advance "quick reverse sound data", which are stored in the quick reverse sound data storage block QM independently of the tune data stored in the tune data storage block M1. Incidentally, it is possible to provide in advance the quick reverse sound data, which are stored in the storage block QM. In that case, it is possible to exclude the quick reverse sound data creation block QP from the aforementioned blocks shown in FIG. 2. When the user operates the quick reverse button, the reproduction control block C1 issues a quick reverse instruction, based on which the reproduction block R1 initiates reverse addressing to the tune data by high-speed tempo clock pulses in a reverse order which is reverse to the normal order of the progression of the musical performance, wherein the system does not reproduce the tune data. In response to the reverse addressing, the system reproduces the quick reverse sound data stored in the storage block QM.

Figure 3A:
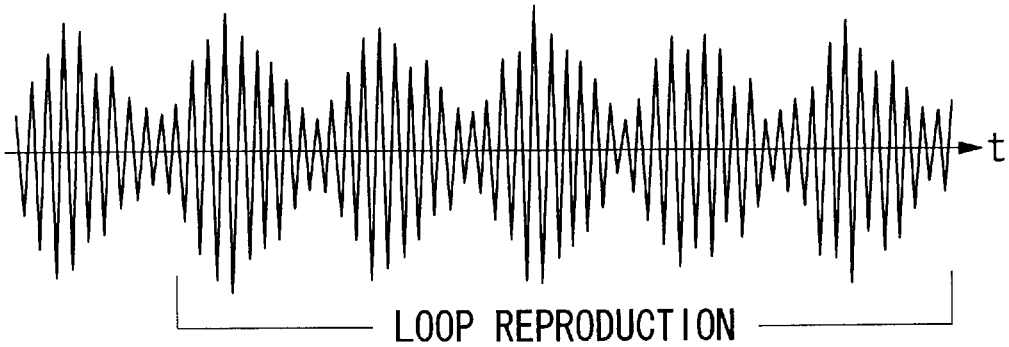
FIG. 3A shows waveform data used for creation of quick reverse sound being reproduced.
Figure 3B:
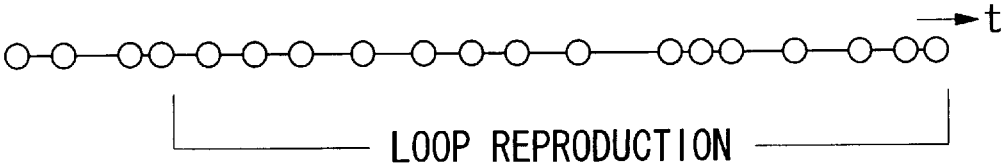
FIG. 3B shows sequence data for creation of quick reverse sound being reproduced.

Examples of the quick reverse sound data employed in the first embodiment are shown in FIGS. 3A and 3B. That is, it is possible to use waveform data as shown in FIG. 3A, or it is possible to use sequence data of a MIDI type as shown in FIG. 3B. As the waveform data of FIG. 3A, it is possible to provide specific noise or creak simulating sound of "kuru-kuru" which is produced when rewinding a magnetic tape in a magnetic-tape player/recorder, for example. So, the system reproduces the aforementioned waveform data as quick reverse sound. FIG. 3B shows the sequence data in which plenty of event data emerge to simulate the quick reverse sound within a short period of time. In FIG. 3B, each of the note events is designated by a small circle "○" to secure a prescribed sound duration.

It is possible to employ loop reproduction by which a part or an entire part of the waveform data or sequence data (see FIGS. 3A, 3B) is repeatedly reproduced in response to a quick reverse time being designated by the user. The loop reproduction is advantageous because it contributes to reduction of memory capacity needed for storing the waveform data or sequence data. In addition, it provides the user with a quick reverse feeling in which the quick reverse sound corresponds to regular repetition of sound. Incidentally, the quick reverse sound data corresponding to the sequence data of FIG. 3B can be configured as data of a single track (representing a single tone color), or they can be configured as data of multiple tracks (representing multiple tone colors).

It is possible to provide various manners to create and handle the quick reverse sound, as follows:

(1) There are provided in advance general-purpose quick reverse sound data, which are irrelevant to a tune being presently played back and which are used for all tune data.

(2) There are provided in advance specific quick reverse sound data to suit to each genre or each tone color of tune data, so that the quick reverse sound data are to be selectively used in conformity with the genre or tone color of the tune data presently reproduced.

(3) Quick reverse sound used for quick reverse of tune data is created based on the tune data in advance.

In the aforementioned case (3), it is possible to create the quick reverse sound from a part of the tune data which starts from any one of prescribed positions (e.g., top position, intermediate position and end position) of the tune. Herein, the position of the tune data by which the quick reverse sound is to be created can be designated by the user, or it can be automatically determined by the system. In addition, the quick reverse sound can be created from the aforementioned sequence data, a number of tracks of which is identical to or smaller than that of original tune data.

Figure 4:
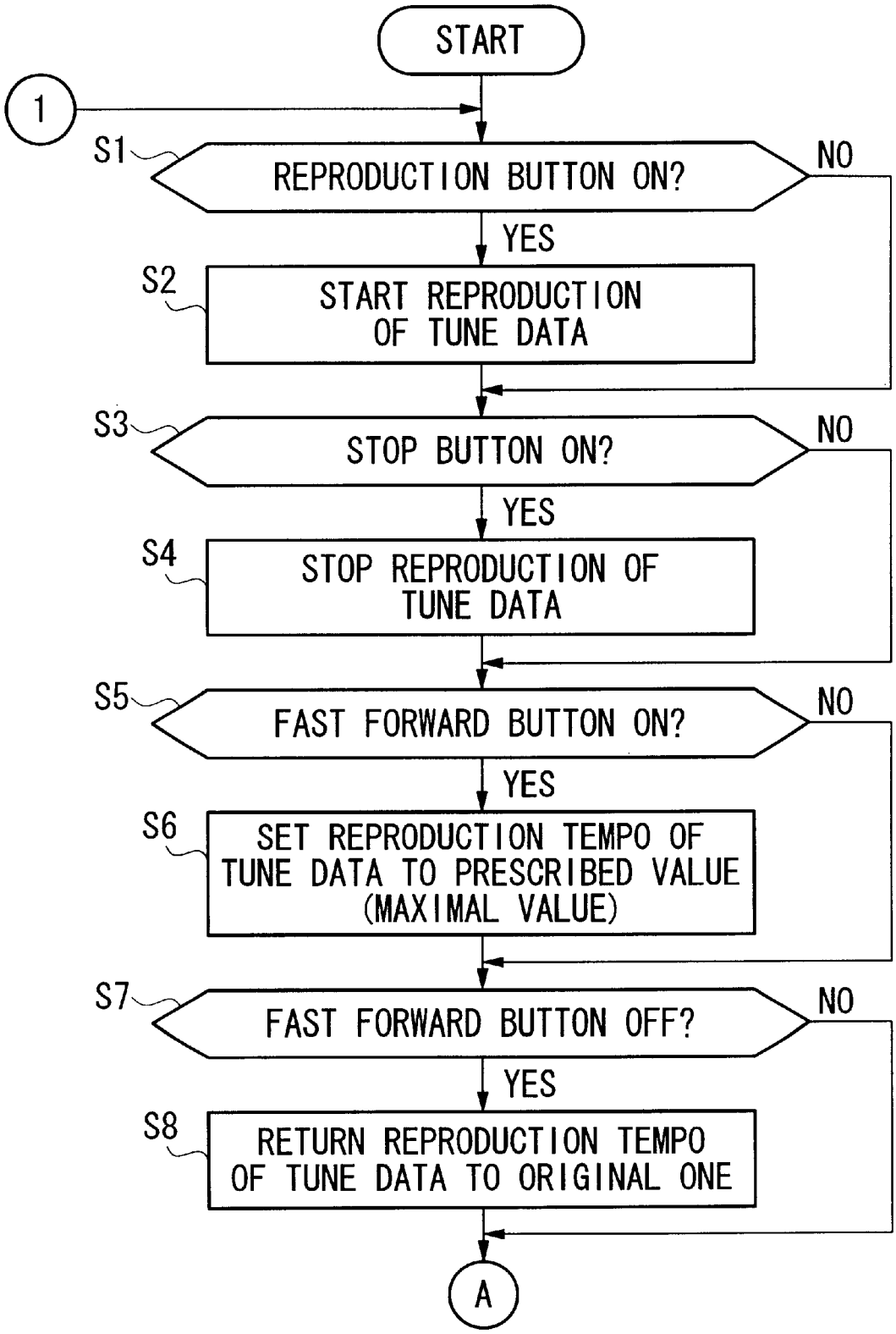
FIG. 4 is a flowchart showing a first part of a tune data reproduction process in accordance with the first embodiment of the invention.
Figure 5:
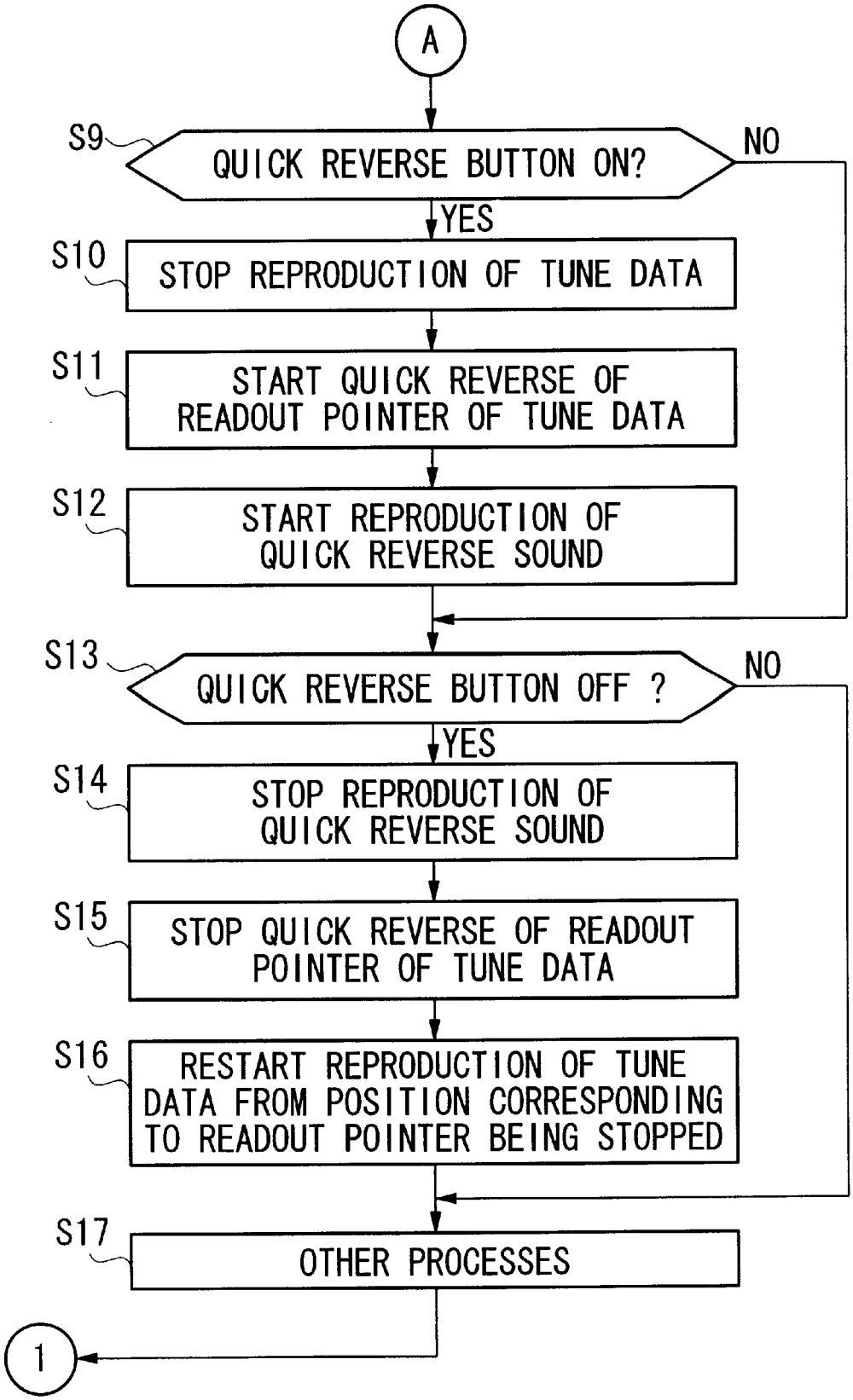
FIG. 5 is a flowchart showing a second part of the tune data reproduction process in accordance with the first embodiment of the invention.

FIGS. 4 and 5 show a tune data reproduction process in accordance with the first embodiment of the invention. In the tune data reproduction process of FIGS. 4 and 5, the reproduction block R1 executes processes respectively regarding a normal reproduction mode, a stop mode and a fast forward mode (or high-speed reproduction mode) in response to operations of the operation device 13 or operations of the reproduction, stop and fast forward buttons on the screen of the display 14. In addition, it also executes a process of a quick reverse mode using quick reverse sound data in response to an operation of the quick reverse button.

In FIG. 4, the flow firstly proceeds to step S1 in which a decision is made as to whether the reproduction button is operated ON or not. If the user turns on the reproduction button, the flow proceeds to step S2 in which the system starts reproducing tune data, read from the tune data storage block M1, by a normal tempo in a forward direction corresponding to progression of performance. Then, the flow proceeds to step S3. If the user does not press or click the reproduction button with the mouse in step S1, the flow proceeds directly to step S3 without performing step S2. In step S3, a decision is made as to whether the stop switch is ON or not. If the user presses or clicks the stop switch with the mouse, the flow proceeds to step S4 in which the system stops reproducing the tune data, then, the flow proceeds to step S5. If not, the flow proceeds directly to step S5.

In step S5, a decision is made as to whether the fast forward button is ON or not. If the user presses or clicks the fast forward button with the mouse, the flow proceeds to step S6 in which a reproduction tempo of the tune data is set to a prescribed value (e.g., maximal value), then, the flow proceeds to step S7. If the user does not press or click the fast forward button in step S5, the flow proceeds directly to step S7. In step S7, a decision is made as to whether the fast forward button is OFF or not. If the user turns off the fast forward button, the flow proceeds to step S8 in which the system restores the reproduction tempo of the tune data to original one (namely, normal tempo), then, the flow proceeds to step S9 (see FIG. 5). If not, the flow proceeds directly to step S9.

In step S9, a decision is made as to whether the quick reverse button is ON or not. If the user presses or clicks the quick reverse button with the mouse, the flow proceeds to a series of steps S10 to S12, then, the flow proceed to step S13. If not, the flow proceeds directly to step S13. That is, if the system detects an ON event of the quick reverse button, the system stops reproducing the tune data in step S10, then, the system initiates quick reverse of a readout pointer of the tune data, in other words, the system starts high-speed reverse addressing on the tune data in step S11. In step S12, the system starts reproduction of quick reverse sound based on quick reverse sound data read from the quick reverse sound data storage block QM. Thereafter, the flow proceeds to step S13.

In step S13, a decision is made as to whether the quick reverse button is OFF or not. If the user turns off the quick reverse button, the flow proceeds to a series of steps S14 to S16, then, the flow proceeds to step S17. If not, the flow proceeds directly to step S17. That is, if the system detects an OFF event of the quick reverse button, the system stops reproduction of the quick reverse sound in step S14, then, the system stops the quick reverse of the readout pointer of the tune data. In step S16, the system restarts normal reproduction of the tune data from a position corresponding to the readout pointer being stopped. After that, the system executes other processes in step S17. Thereafter, the system repeats the aforementioned steps S1 to S17 as described above. Incidentally, the quick reverse sound data are subjected to loop reproduction in a period of time between a start timing of the reproduction of the quick reverse sound in step S12 and a stop timing of the reproduction of the quick reverse sound in step S14.

Incidentally, the present embodiment can be partially modified with regard to the quick reverse of the readout pointer of the tune data (see steps S11, S15). That is, during an ON state of the quick reverse button, the system does not perform the quick reverse of the readout pointer of the tune data, but the system measures an operation sustain time (i.e., a time that elapses while the quick reverse button is ON) or calculates a return position (i.e., an address or a location of performance of the tune data) corresponding to the operation sustain time. So, when the user turns off the quick reverse button, the readout pointer of the tune data is returned to a destination position by the measured operation sustain time, or it is returned to the calculated return position. In this case, it is preferable that the system notifies the user of variations of the readout pointer of the tune data during its return process. That is, the system visually displays a present position on words and/or chords of musical performance on the basis of an elapsed time during operation of the quick reverse button or a virtual return position which is virtually calculated in connection with the return process of the readout pointer of the tune data, for example.

[C] Second Embodiment

Figure 6:
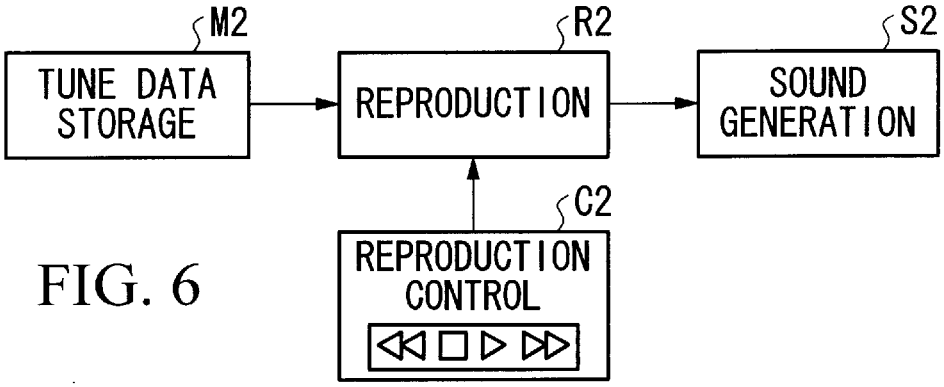
FIG. 6 is a block diagram showing a configuration of a tune data reproduction system in accordance with a second embodiment of the invention.

The present invention allows the system to use reverse reproduction of tune data in the quick reverse mode. That is, when the user instructs quick reverse (or reverse reproduction) on the tune data, the system reversely reproduces the tune data in a reverse direction at a high speed. In the normal reproduction, generation of sound for each note is defined by note-on data and note-off data, so that the sound is originally generated in response to the note-on data, then, the sound is muted in response to the note-off data. In the reverse reproduction, the system starts generation of sound in response to the note-off data being read out, then, the system starts muting the sound after a lapse of a prescribed time (or sound duration). FIG. 6 shows function blocks configuring a tune data reproduction system in accordance with a second embodiment of the invention. Namely, the tune data reproduction system of the second embodiment is configured by a tune data storage block M2, a reproduction control block C2, a reproduction block R2 and a sound generation block S2.

In order to initiate normal reproduction of the tune data, the reproduction control block C2 issues a reproduction instruction by operation of the operation device 13 or operation of the reproduction button on the screen of the display 14. In response to the reproduction instruction, the reproduction block R2 reads out the tune data from the tune data storage block M2 by a normal reproduction tempo in an order corresponding to progression of musical performance, so that the sound generation block S2 correspondingly generates sounds in a normal reproduction mode. In a quick reverse mode which is designated by operation of the quick reverse button, the reproduction control block C2 issues a quick reverse instruction, based on which the reproduction block R2 reads out the tune data from the tune data storage block M2 in response to high-speed tempo clock pulses in a reverse order which is reverse to the progression of the musical performance. So, the system starts generating each sound every time it reads note-off data in the tune data being reversely read out. Then, the system starts muting the sound after a lapse of a prescribed sound duration.

Figure 7A:
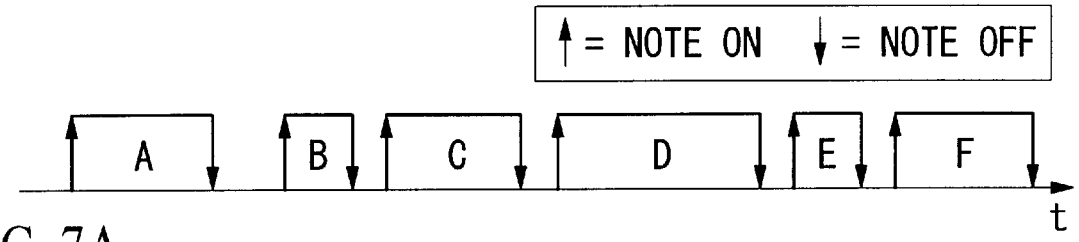
FIG. 7A shows a sequence of generation of sounds of notes in normal reproduction.
Figure 7B:
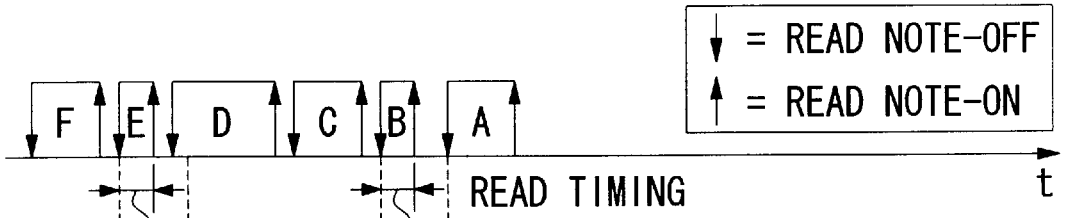
FIG. 7B shows a sequence of reading notes in a reverse direction in quick reverse.
Figure 7C:
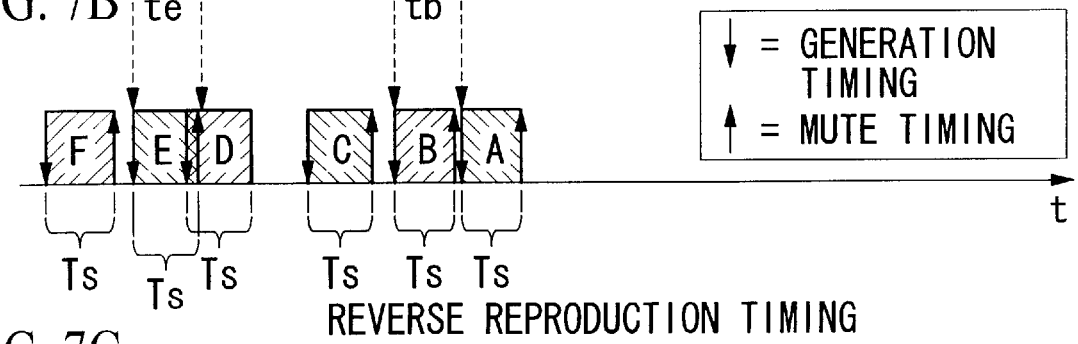
FIG. 7C shows a sequence of reverse reproduction of sounds of the notes using a prescribed duration Ts.

FIGS. 7A to 7C are used to explain detailed operations of the tune data reproduction system of the second embodiment of the invention, wherein upward arrows represent timings of generation of sounds, and downward arrows represent timings of muting of sounds. In a normal reproduction mode, note-on information and note-off information of the tune data are read out in response to clock pulses corresponding to a normal reproduction tempo. That is, as shown in FIG. 7A, the system starts generation of sound at a timing of an upward arrow "↑" designated by note-on information, then, the system starts muting of the sound at a timing of a downward arrow"↓" designated by note-off information. Such operations are sequentially performed in accordance with the tune data, so that the system sequentially reproduces sounds of notes A, B, C, . . . , F as shown in FIG. 7A.

In a quick reverse mode in which sounds are reproduced in a reverse direction reverse to progression of musical performance, note-off information and note-on information of the tune data are read out in response to clock pulses corresponding to a high-speed tempo which is higher in speed than the normal reproduction tempo and which corresponds to a maximal tempo, for example. Herein, the system reversely reproduces sounds corresponding to notes of the tune data by the prescribed short duration. Specifically, the system sequentially reads out note-off information (↓) and note-on information (↑) with respect to notes F, E, D, . . . , A (see FIG. 7B) which are reversely arranged as compared with normal arrangement (A, B, C, . . . , F) of notes in the progression of the musical tune. As shown in FIG. 7C, the system starts generation of sound at a timing of note-off information being read out, then, the system starts muting of the sound after a lapse of a prescribed duration Ts which is determined in advance. Thus, the system reversely reproduces sounds of the notes F, E, D, . . . , A in the reverse direction. As described above, it is possible to perform reverse reproduction on the tune data by a high-speed tempo (e.g., maximal tempo) which is determined in advance.

According to the conventional technology, the conventional system starts generation of quick reverse sound at a timing of note-off information, then, the system starts muting of the quick reverse sound at a timing of note-on information being read out, for example. In that case, the conventional system suffers from a problem in that duration of sound of each note defined between its generation start timing and mute start timing becomes excessively short, which is shown by times te and tb representing durations of notes E, B in FIG. 7B. In contrast to the conventional technology, the system of the present embodiment is designed to start muting of sound after a lapse of a prescribed duration Ts (see FIG. 7C). Namely, it is possible to secure a sufficient time for generation of sound (i.e., prescribed duration Ts) with respect to each of notes of the tune data. In addition, if the tune data contain plenty of notes each having a long duration, heavy load is to be imparted to the sound generation block S2 in processing in the conventional technology. In the present embodiment, the system starts muting of sound after a lapse of a prescribed duration which is fixed. This contributes to reduction of notes each having a long duration in reverse reproduction of the tune data. Thus, it is possible to reduce an amount of processing of the sound generation block S2.

Incidentally, it is necessary to secure a certain time for generation of sound as the prescribed duration Ts in the reverse reproduction. For example, it is set to 100 ms or so. In addition, setting of the duration Ts needs plural timers (i.e., timer 11 shown in FIG. 1) in order to allow simultaneous generation of plural sounds. In that case, each note whose sound is started in generation is connected with each timer. So, after the timer completes measuring the prescribed duration Ts, sound of the corresponding note is started in muting.

In the second embodiment described above, the tune data are subjected to reverse reproduction in such a manner that generation of sound is started in response to note-off information being read out. Incidentally, the second embodiment is not necessarily limited to reversely reproduce all sounds on all tracks of the tune data. That is, it is possible to reversely reproduce sounds on a part of the tracks of the tune data. In addition, it is possible to reversely reproduce a limited number of sounds based on a part of note-off information of the tune data, which is thinned out.

Further, the system of the present embodiment can be modified such that the user is capable of arbitrarily setting the foregoing prescribed duration Ts defined between a generation timing and a mute timing of sound in the reverse reproduction. Furthermore, it is preferable that the system of the present embodiment copes with variations of tone colors and tone volumes in middle parts of the tune data. That is, if the system reads out tone color data and/or tone volume data in the reverse reproduction, the system searches previous tone color data and/or tone volume data which previously emerge in the tune data, so that the system reversely reproduces sounds (e.g., musical tones) based on the previous tone color data and/or tone volume data being searched out.

Figure 8:
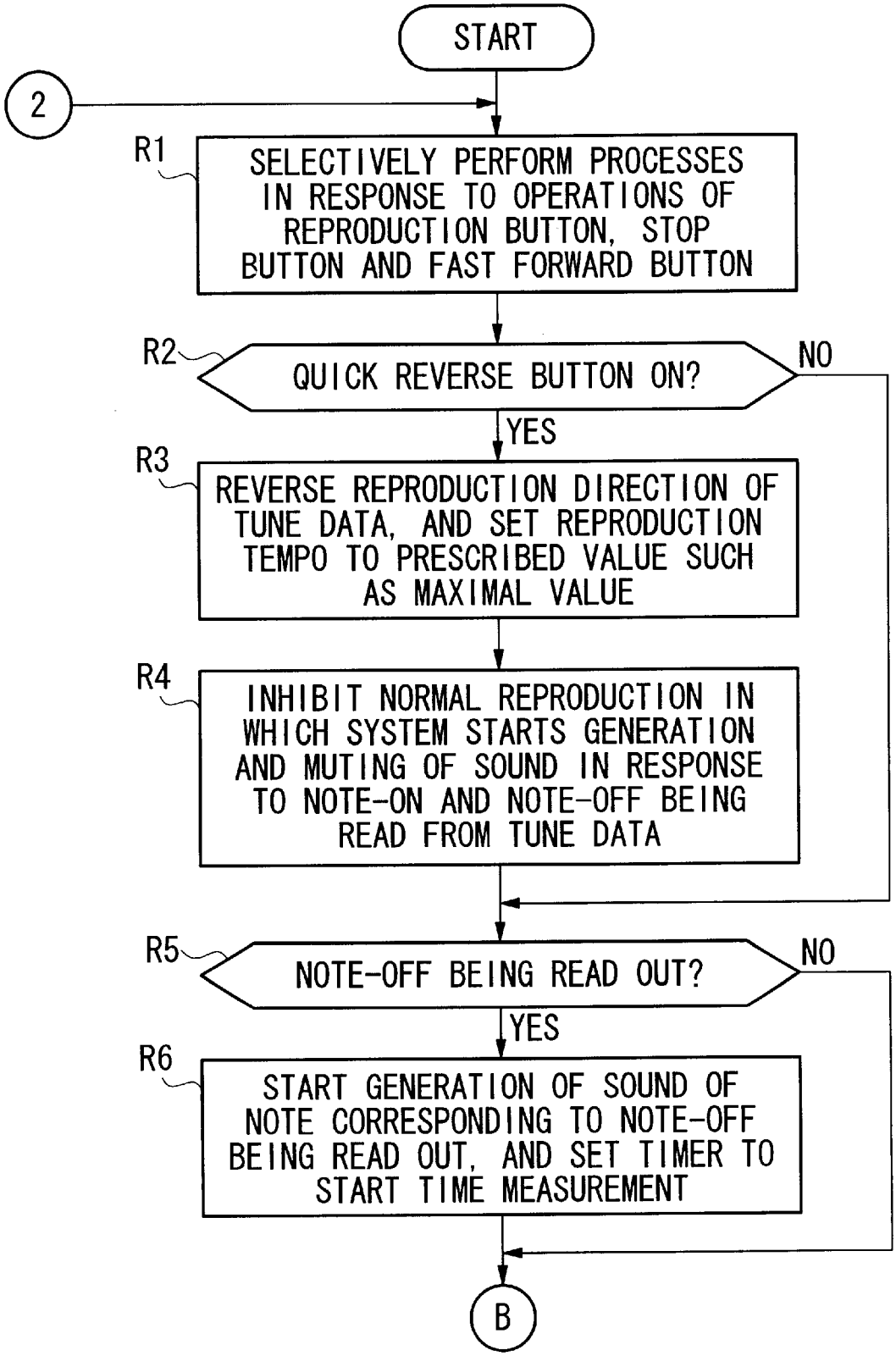
FIG. 8 is a flowchart showing a first part of a tune data reproduction process in accordance with the second embodiment of the invention.
Figure 9:
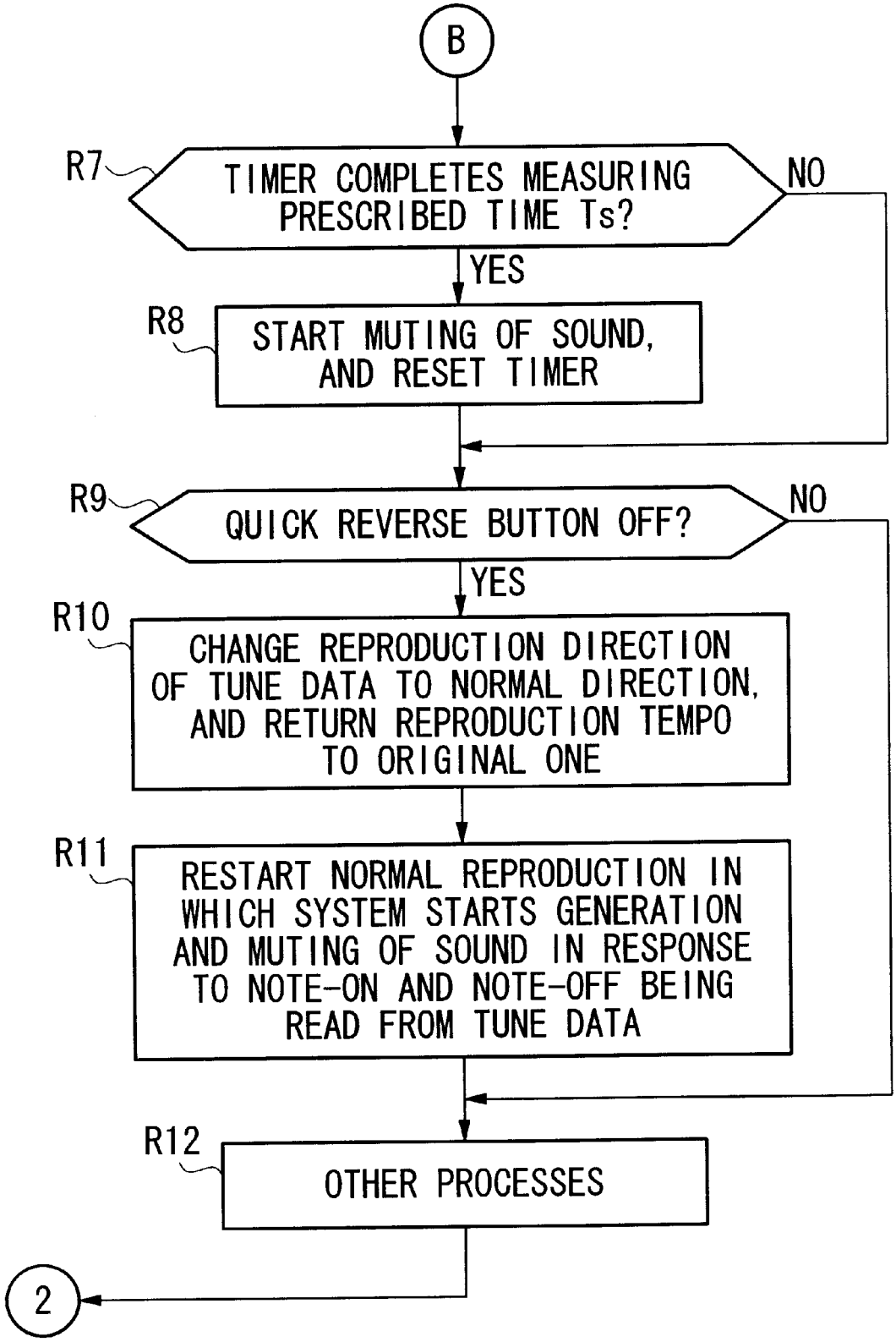
FIG. 9 is a flowchart showing a second part of the tune data reproduction process in accordance with the second embodiment of the invention.

FIGS. 8 and 9 show a tune data reproduction process in accordance with the second embodiment of the invention. Like the foregoing first embodiment, the second embodiment is designed such that the reproduction block R2 executes processes respectively regarding a normal reproduction mode, a stop mode and a fast forward (or high-speed reproduction) mode in response to operations of the operation device 13 or operations of the reproduction button, stop button and fast forward button on the screen of the display 14. In addition, the reproduction block R2 executes a process of a quick reverse mode corresponding to the aforementioned reverse reproduction of the tune data in response to an operation of the quick reverse button.

In FIG. 8, the flow firstly proceeds to step R1, content of which is similar to the foregoing steps S1 to S8 of the first embodiment shown in FIG. 4. Namely, the system of the second embodiment executes the prescribed processes in response to operations of the reproduction button, stop button and fast forward button respectively. Specifically, when the user turns on the reproduction button, the reproduction block R2 reads out tune data from the tune data storage block M2, so that the system starts to reproduce the tune data by a normal reproduction tempo in a normal direction corresponding to progression of the musical tune. When the user presses or clicks the stop button with the mouse, the system stops reproduction of the tune data. When the user presses or clicks the fast forward button with the mouse, the system sets the reproduction tempo of the tune data to a prescribed value (e.g., maximal value), so that the tune data are reproduced by a high-speed tempo. When the user turns off the fast forward button, the system returns the reproduction tempo of the tune data to original one.

In step R2, a decision is made as to whether the quick reverse button is ON or not. If the user presses or clicks the quick reverse button with the mouse, the flow sequentially proceeds to steps R3 and R4, then, the flow proceeds to step R5. If not, the flow proceeds directly to step R5. Namely, if the system detects that the quick reverse button is ON, the flow proceeds to step R3 in which the system reverses a reproduction direction of tune data, and it also sets a reproduction tempo to a prescribed value (e.g., maximal value). In step R4, the system changes the setting of processing conditions such as to inhibit the normal reproduction in which the system starts generation and muting of sound in response to note-on information and note-off information being read from the tune data. Then, the flow proceeds to step R5.

In step R5, a decision is made as to whether note-off information is read from the tune data or not. If "YES", the flow proceeds to step R6 in which the system starts generation of a sound of a note corresponding to the note-off information read from the tune data. In addition, the system sets a prescribed duration Ts to the timer 11. Then, the flow proceeds to step R7 shown in FIG. 9. If the system detects in step R5 that note-off information is not read from the tune data, the flow directly proceeds to step R7. In step R7, a decision is made as to whether the timer completes measuring the prescribed time Ts or not. If "YES", the flow proceeds to step R8 in which the system stops generation of the sound and also resets the timer 11, then, the flow proceeds to step R9. If "NO", the flow directly proceeds to step R9.

In step R9, a decision is made as to whether the quick reverse button is OFF or not. If the user turns off the quick reverse button, the flow sequentially proceeds to steps R10 and R11, then, the flow proceeds to step R12. If not, the flow directly proceeds to step R12. Namely, if the system detects in step R9 that the quick reverse button is OFF, the flow proceeds to step R10 in which the system changes the reproduction direction of the tune data to the normal direction, and the system also returns the reproduction tempo to original one. In step R11, the system restores the setting of the processing conditions such as to restart the normal reproduction in which the system starts generation and muting of sound in response to note-on information and note-off information being read from the tune data. Thus, the system restarts the reproduction of the tune data from a readout position which is designated when the user turns off the quick reverse button. After completion of the step R11, the flow proceeds to step R12 in which the system performs other processes. Thereafter, the flow reverts control to the foregoing step R1. Thus, the system repeats the aforementioned steps as described heretofore.

[D] Modifications

This invention is not necessarily limited to the aforementioned embodiments, particularly, operations and processing regarding the quick reverse mode are not necessarily limited to the foregoing embodiments. For example, the system can be modified to install a function of changing a tempo in a quick reverse mode. In that case, the system can be reconfigured such that the operation device 13 additionally installs a dial-type tempo operator to allow changes of the tempo in the quick reverse mode (and fast forward mode). That is, the system is capable of controlling the tempo in the quick reverse mode (or fast forward mode) in response to rotation speed or rotation position of the tempo operator. Incidentally, the aforementioned tempo operator can be applied to reverse reproduction in which sounds are reversely reproduced at a normal tempo in addition to the quick reverse in which sounds are reversely reproduced at a high speed.

As formatting of the tune data, it is possible to employ a variety of formats, as follows:

(i) Format of "event plus relative time" in which an occurrence time of a performance event is represented by a time being elapsed from a preceding event.

(ii) Format of "event plus absolute time" in which an occurrence time of a performance event is represented by an absolute time within a tune or a measure.

(iii) Format of "pitch (or rest) plus length" in which tune data are constructed using a pitch of a note and a note length, or a rest and its length.

(iv) Format of "solid method" in which a memory area is secured by minimal resolution of performance, so that a performance event is stored in a memory area corresponding to an occurrence time.

In addition, the system is not necessarily configured such that a note-on event and a note-off event are independently stored in the storage. That is, it is possible to deal each event in form of "note-on plus gate time", which is stored in the storage. In that case, the system is modified such that in the quick reverse mode, a note-on event is read out from the tune data at first, then, generation of sound is initiated at a timing that precedes the event by the gate time.

As the processing method of the tune data, it is possible to employ a variety of methods, as follows:

(i) First method in which a processing period is changed in response to a tempo being set.

(ii) Second method in which the processing period is made constant while values of timing data within the tune data are changed in response to the tempo being set.

(iii) Third method in which the processing period is made constant while a manner of counting timing data within the tune data at one processing is changed in response to the tempo being set.

As the storage method of the tune data of plural channels, it is possible to employ the following methods.

(i) Mixture storage method in which data of plural channels are stored in a mixed manner.

(ii) Independent storage method in which data of plural channels are stored independently on different tracks so that each channel is related to each single track.

It is possible to use time-series tune data which are stored in consecutive areas on the memory, or it is possible to manage multiple data stored in different areas, which are arranged at intervals in the memory, as consecutive data. Namely, this invention requires the tune data to be managed as time-series consecutive data. So, no problem is raised as to whether the tune data are actually stored in a consecutive manner on the memory or not.

As described heretofore, this invention has a variety of technical features and effects, which are described below.

(1) The tune data reproduction system of the first embodiment is designed to provide quick reverse sound data independently of tune data, by which the system operates differently in a normal reproduction mode and a quick reverse mode. In the normal reproduction mode, the system generates musical tones based on the tune data by sequentially reading out constituent notes of the tune data in a normal direction corresponding to progression of musical performance at a first speed. In the quick reverse mode, the system performs reverse addressing in a reverse direction, which is reverse to the progression of the musical performance, at a second speed which is higher than the first speed. In addition, the system generates quick reverse sound based on the quick reverse sound data. Therefore, the system does not make duration between a generation start timing and a mute start timing to be excessively short with respect to each of the constituent notes of the tune data in the quick reverse mode. Thus, the user of the system is capable of certainly listening to the quick reverse sound so as to clearly recognize passage of quick reverse operation.

(2) In the above, the tune data and quick reverse sound data are configured by prescribed waveform data or sequence data. Hence, it is possible to employ various forms of sound data other than data of the MIDI format. In addition, a revere reproducer of the system reproduces the quick reverse sound by repeatedly reading out a part of the quick reverse sound data or by repeatedly reading out an entire part of the quick reverse sound data. This contributes to generation of the quick reverse sound to be suited to the quick reverse mode.

(3) Unlike the first embodiment, the tune data reproduction system of the second embodiment does not use the quick reverse sound data but is also designed to operate differently in the normal reproduction mode and quick reverse mode. That is, in the normal reproduction mode, the system sequentially reads out constituent notes of tune data in a normal direction corresponding to progression of musical performance at a first speed, so that the system starts generation and muting of a sound of a note in response to note-on information and note-off information being read from the tune data. In the quick reverse mode, the system reads out the constituent notes of the tune data in a reverse direction, which is reverse to the progression of the musical performance, at a second speed which is higher than the first speed. Herein, the system starts generation of a sound of a note in response to note-off information being read from the tune data, however, the system does not respond to note-on information so that the system starts muting of the sound of the note after a lapse of a prescribed duration that elapses from a generation start timing of the sound. Therefore, the system does not make duration between a generation start timing and a mute start timing to be excessively short with respect to each of the constituent notes of the tune data. Thus, the user is capable of tracing back the tune data in the reverse direction at a high speed while certainly and clearly listening to sounds of the constituent notes of the tune data, wherein the user is able to recognize tonality of a tune.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds are therefore intended to be embraced by the claims.

What is claimed is:

1. A tune data reproduction apparatus comprising:

a first storage for storing a series of forward reproduction sound data, wherein the forward reproduction sound data are to be reproduced in a forward direction corresponding to progression of musical performance of a musical tune;

a second storage for storing a series of reverse reproduction sound data separately from the forward reproduction sound data, representing sound data to be reproduced in a reverse direction that is reverse to the progression of the musical performance of the musical tune; and a reproducer for reproducing the reverse reproduction sound data stored in the second storage in response to a reverse reproduction instruction.

2. A tune data reproduction apparatus according to claim 1, wherein the reproducer reproduces the forward reproduction sound data in response to a forward reproduction instruction.

3. A tune data reproduction apparatus according to claim 2, wherein when receiving the reverse reproduction instruction during reproduction of the forward reproduction sound data in progress, the reproducer stops reproducing the forward reproduction sound data and makes addressing in the reverse direction, which is reverse to the forward direction, with respect to the forward reproduction sound data.

4. A tune data reproduction apparatus according to claim 2 wherein the reverse reproduction sound data correspond to waveform data.

5. A tune data reproduction apparatus according to claim 2 wherein the reverse reproduction sound data correspond to sequence data.

6. A tune data reproduction apparatus according to claim 1 wherein the reproducer reproduces the reverse reproduction sound data by repeatedly reading out at least a part of the reverse reproduction sound data.

7. A tune data reproduction apparatus according to claim 1 wherein the reproducer performs reverse reproduction of the reverse reproduction sound data at a high speed which is higher than a speed at which the reproducer performs reproduction of the forward reproduction sound data.

8. A tune data reproduction apparatus according to claim 1 wherein the reverse reproduction sound data are created from the forward reproduction sound data.

9. A tune data reproduction apparatus comprising:

a tune data provider for providing forward reproduction sound data that contain at least note-on information and note-off information with respect to each of notes of musical performance;

a reproducer for sequentially reading out the forward reproduction sound data in accordance with progression of the musical performance, so that the reproducer starts generation and muting of sound with respect to each of the notes in response to the note-on information and the note-off information respectively, and for sequentially reading out the forward reproduction sound data in a reverse direction, which is reverse to the progression of the musical performance, so that the reproducer starts generation of sound with respect to each of the notes in response to the note-off information, and then the reproducer starts muting of the sound, independent of the note-on information, after an elapse of a prescribed time counted from a start timing in generation of sound.

10. A tune data reproduction apparatus according to claim 9 wherein the reproducer performs reverse reproduction at a high speed that is higher than a speed at which the reproducer performs reproduction of the forward reproduction sound data.

11. A tune data reproduction apparatus according to claim 9 further comprising an operator for allowing a user to arbitrarily set the prescribed time defined between a generation start timing and a mute start timing.

12. A tune data reproduction apparatus comprising:

a tune data storage for storing a series of tune data which represents musical performance realized by progression of notes;

a quick reverse sound data storage for storing a series of quick reverse sound data, which represents quick reverse sound created based on the tune data;

a reproducer for in a reproduction mode, sequentially reading out the tune data from the tune data storage to reproduce musical tones of the notes in accordance with progression of the musical performance, or for in a quick reverse mode, reading out the quick reverse sound data from the quick reverse sound data storage to reproduce the quick reverse sound; and a readout speed controller for controlling a readout speed for the reproducer, so that the reproducer reproduces the musical tones or the quick reverse sound at a desired tempo under control of the readout speed controller.

13. A tune data reproduction apparatus according to claim 12 wherein the quick reverse sound data represent at least a part of the tune data to be reversely reproduced in a reverse direction which is reverse to the progression of the musical performance.

14. A tune data reproduction apparatus according to claim 13 wherein the readout speed controller sets a high speed to the reproducer for reversely reproducing at least the part of the tune data, so that the musical tones are being reversely produced with a fast tempo.

15. A tune data reproduction apparatus according to claim 12 wherein in the reproduction mode, the reproducer starts generation and muting of a musical tone with respect to each of the notes in response to note-on information and note-off information being respectively read from the tune data.

16. A tune data reproduction apparatus according to claim 12 wherein the quick reverse sound correspond to repetition of a prescribed sound indicating a quick reverse operation.

17. A tune data reproduction apparatus according to claim 13 wherein in the quick reverse mode, the reproducer starts generation of a musical tone with respect to each of the notes being reversely reproduced in response to note-off information being read from the tune data, then, the reproducer starts muting of the musical tone after a lapse of a prescribed duration which is determined in advance.

18. A tune data reproduction method comprising the steps of:

storing a series of forward reproduction sound data, wherein the forward reproduction sound data are to be reproduced in a forward direction corresponding to progression of musical performance of a musical tune;

storing a series of reverse reproduction sound data separately from the forward reproduction sound data, representing sound data to be reproduced in a reverse direction that is reverse to the progression of the musical performance of the musical tune; and reproducing the reverse reproduction sound data in response to a reverse reproduction instruction.

19. A tune data reproduction method comprising the steps of:

providing tune data that contain at least note-on information and note-off information with respect to each of notes of musical performance;

sequentially reading out the tune data in accordance with progression of the musical performance, wherein generation and muting of sound are started with respect to each of the notes in response to the note-on information and the note-off information respectively; and sequentially reading out the tune data in a reverse direction, which is reverse to the progression of the musical performance, wherein the generation of sound is started with respect to each of the notes in response to the note-off information, and then, muting of the sound is started, independent of the note-on information, after an elapse of a prescribed time counted from a start timing in generation of sound.

20. A tune data reproduction method comprising the steps of:

storing a series of tune data, which represents musical performance realized by progression of notes;

storing a series of quick reverse sound data, which represents quick reverse sound created based on the tune data;

in a reproduction mode, sequentially reading out the tune data to reproduce musical tones of the notes in accordance with progression of the musical performance; and in a quick reverse mode, reading out the quick reverse sound data to reproduce the quick reverse sound, wherein a readout speed is controlled in the reproduction mode or the quick reverse mode, so that the musical tones or the quick reverse sound is reproduced at a desired tempo.

21. A machine-readable media storing programs that cause a computer system to perform a tune data reproduction method comprising the steps of:

storing a series of forward reproduction sound data, wherein the forward reproduction sound data are to be reproduced in a forward direction corresponding to progression of musical performance of a musical tune;

storing a series of reverse reproduction sound data separately from the forward reproduction sound data, representing sound data to be reproduced in a reverse direction that is reverse to the progression of the musical performance of the musical tune; and reproducing the reverse reproduction sound data in response to a reverse reproduction instruction.

22. A machine-readable media storing programs that cause a computer system to perform a tune data reproduction method comprising the steps of:

providing tune data that contain at least note-on information and note-off information with respect to each of notes of musical performance;

sequentially reading out the tune data in accordance with progression of the musical performance, wherein generation and muting of sound are started with respect to each of the notes in response to the note-on information and the note-off information respectively; and sequentially reading out the tune data in a reverse direction, which is reverse to the progression of the musical performance, wherein the generation of sound is started with respect to each of the notes in response to the note-off information, and then, muting of the sound is started, independent of the note-on information, after an elapse of a prescribed time counted from a start timing in generation of sound.

23. A machine-readable media storing programs that cause a computer system to perform a tune data reproduction method comprising the steps of:

storing a series of tune data, which represents musical performance realized by progression of notes;

storing a series of quick reverse sound data, which represents quick reverse sound created based on the tune data;

in a reproduction mode, sequentially reading out the tune data to reproduce musical tones of the notes in accordance with progression of the musical performance; and in a quick reverse mode, reading out the quick reverse sound data to reproduce the quick reverse sound, wherein a readout speed is controlled in the reproduction mode or the quick reverse mode, so that the musical tones or the quick reverse sound is reproduced at a desired tempo.

* * * * *